US008485855B1

(12) United States Patent
Vogel

(10) Patent No.: US 8,485,855 B1
(45) Date of Patent: Jul. 16, 2013

(54) APPARATUS FOR RESTORING BUOYANCY TO A BUOY

(76) Inventor: Daniel R. Vogel, Rutherfordton, NC (US)

( * ) Notice: Subject to any disclaimer, the term of this patent is extended or adjusted under 35 U.S.C. 154(b) by 267 days.

(21) Appl. No.: 12/846,143

(22) Filed: Jul. 29, 2010

(51) Int. Cl.
*B63B 22/24* (2006.01)

(52) U.S. Cl.
USPC ..... 441/6

(58) Field of Classification Search
USPC ..... 441/1–34, 136
See application file for complete search history.

(56) References Cited

U.S. PATENT DOCUMENTS 2,897,625 A 8/1959 Spitzli et al.
3,332,093 A * 7/1967 Skinner et al. ..... 441/133
3,597,779 A * 8/1971 Morgan ..... 441/133
3,942,203 A 3/1976 Perkins
4,079,970 A 3/1978 Brett
4,386,919 A 6/1983 Kadono
4,781,636 A 11/1988 Schurr
5,218,366 A * 6/1993 Cardamone et al. ..... 342/385
5,330,378 A 7/1994 Park
5,411,424 A 5/1995 Hill

OTHER PUBLICATIONS

Rolyan buoy catalog 10B. Rolyan Buoys, P.O. Box 886, Cedarburg, WI 53012. Effective date unknown. www.RolyanBuoys.com.

* cited by examiner

*Primary Examiner* — Edwin Swinehart
(74) *Attorney, Agent, or Firm* — The Van Winkle Law Firm; Steven C. Schnedler

(57) ABSTRACT

Apparatus and methods for restoring buoyancy to a buoy, such as a cylindrical regulatory buoy, which has an intended waterline. A buoyant body generally of ring configuration includes an axial central aperture and has a buoyant body inside diameter corresponding to the diameter of a cylindrical portion of the buoy. The buoyant body is attached to the buoy generally in the vicinity of or below the intended waterline, with the buoy cylindrical portion extending through the central aperture of the buoyant body.

12 Claims, 8 Drawing Sheets

APPARATUS FOR RESTORING BUOYANCY TO A BUOY

BACKGROUND OF THE INVENTION

The invention relates generally to buoys such as, but not limited to, regulatory buoys which take the form of a flotation foam-filled cylinder, weighted at the bottom, so that the buoy stands upright in the water.

The United States Code of Federal Regulations includes provisions relating to "Navigation and Navigable Waters," including provisions pertaining to "Beacons and buoys." 33 CFR §62.33 in particular reads:

Information and regulatory marks.

(a) Information and Regulatory Marks are used to alert the mariner to various warnings or regulatory matters. These marks have orange geometric shapes against a white background. The meanings associated with the orange shapes are as follows:

(1) A vertical open-faced diamond signifies danger.

(2) A vertical diamond shape having a cross centered within indicates that vessels are excluded from the marked area.

(3) A circular shape indicates that certain operating restrictions are in effect within the marked area.

(4) A square or rectangular shape will contain directions or instructions lettered within the shape.

(b) When a buoy is used as an information or regulatory mark it shall be white with two horizontal orange bands placed completely around the buoy circumference. One band shall be near the top of the buoy body, with a second band placed just above the waterline of the buoy so that both bands are clearly visible.

In the context of the subject invention, 33 CFR §62.33(b) quoted above is of particular relevance, requiring that the second band be "placed just above the waterline of the buoy so that both bands are clearly visible."

More particularly, over time regulatory buoys tend to absorb water and partially lose their buoyancy. A critical point is reached when the "second band" of the "two horizontal orange bands" sinks below the surface of the waterway. In other words, as the buoy becomes less buoyant, the actual waterline of the buoy is above rather than below the "second band."

Conventional practice is to replace such out-of-compliance buoys, which then typically eventually find their way to a landfill.

Buoy restoration materials and kits are available. However, such restoration materials and kits generally are directed to renewing the appearance of a buoy, or to repairing damage, before excessive infiltration of water into the buoyant foam material has occurred.

SUMMARY OF THE INVENTION

In one aspect, apparatus is provided for restoring buoyancy to a buoy which has an intended waterline. The apparatus includes a buoyant body generally of ring configuration including an axial central aperture and having a buoyant body inside diameter corresponding to the diameter of a cylindrical portion of the buoy. An attachment secures the buoyant body to the buoy generally in the vicinity of or below the intended waterline. The buoy cylindrical portion extends through the central aperture of the buoyant body.

In another aspect, a restored buoy assembly is provided. The assembly includes a buoy which has an intended waterline and at least including a cylindrical portion having a diameter; a buoyant body generally of ring configuration including an axial central aperture and having a buoyant body inside diameter corresponding to the diameter of the cylindrical portion of the buoy. The buoyant body is secured to the buoy generally in the vicinity of or below the intended waterline, the buoy cylindrical portion extending through the central aperture.

In yet another aspect, a method is provided for restoring buoyancy to a buoy which has an intended waterline and which at least includes a cylindrical portion having a diameter. A buoyant body generally of ring configuration is provided, the buoyant body including an axial central aperture and having a buoyant body inside diameter corresponding to the diameter of the cylindrical portion of the buoy. The buoyant body is fitted and attached to the buoy generally in the vicinity of or below the intended waterline, with the buoy cylindrical portion extending through the central aperture of the buoyant body.

DETAILED DESCRIPTION

Figure 1:
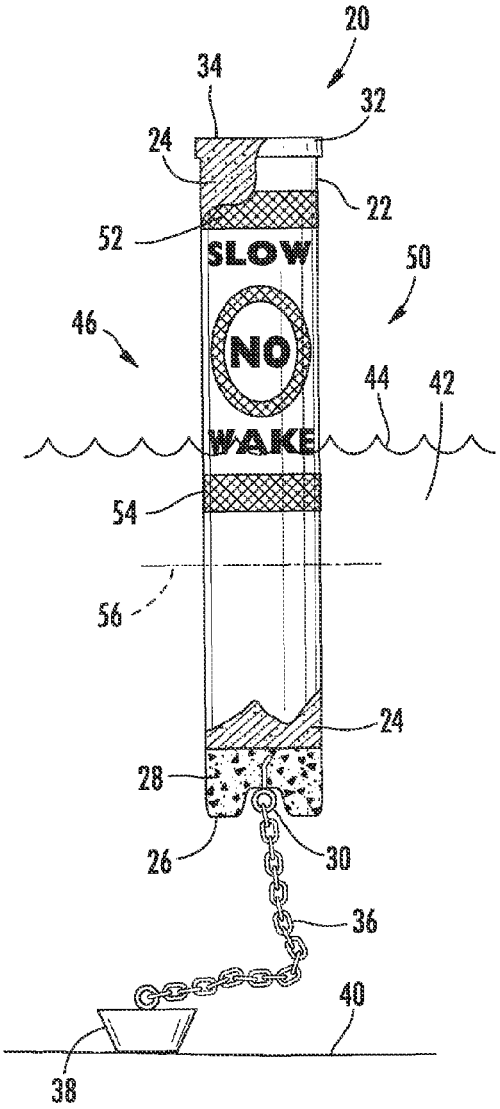
FIG. 1 illustrates a regulatory buoy which has partially lost its buoyancy.

FIG. 1 illustrates a representative regulatory buoy 20 which has partially lost its buoyancy. The particular buoy 20 is generally cylindrical, sixty-one inches in overall height, and nine inches in diameter. The cylindrical body of the buoy 20 is made of a hollow tube of high-density polyethylene (HDPE) essentially filled with urethane foam 24 for buoyancy, except at its lower end 26. Acrylonitrile butadiene styrene (ABS) is also sometimes employed as a buoy material, rather than HDPE. Concrete ballast 28 is provided at the lower end 26 with an anchoring eye 30 cast within the concrete ballast 28. A cap 32 is provided at the upper end 34 of the buoy 20. When installed, an anchor chain 36 extends between the anchoring eye 30 and an anchor 38 resting on the bottom 40 of a body of water 42 having a surface 44.

The buoy 20 accordingly at least includes a cylindrical portion, generally designated 46, having a diameter. The particular buoy illustrated is essentially entirely cylindrical. Orange-colored information and regulatory marks, generally designated 50, are provided on the body of the buoy 20, including upper and lower orange bands 52 and 54.

When newly manufactured, the buoy 20, by way of example, weighs forty-nine pounds and has a buoyancy, when fully submerged, of eighty-four pounds. The buoy 20 has a design or intended waterline 56.

Taking into account anchor tackle (i.e. the anchor chain 36), the design or intended waterline 56 is approximately thirty-six inches below the upper end 34 of the buoy 20. Significantly, the marks 50, including in particular the lower orange band 54, are above the intended waterline 56.

However, the particular buoy 20 illustrated in FIG. 1 has partially lost its buoyancy, such as due to the infiltration of water into the urethane foam 24. As a result, the lower orange band 54 is submerged below the surface 44 of the body of water 42.

Figure 2:
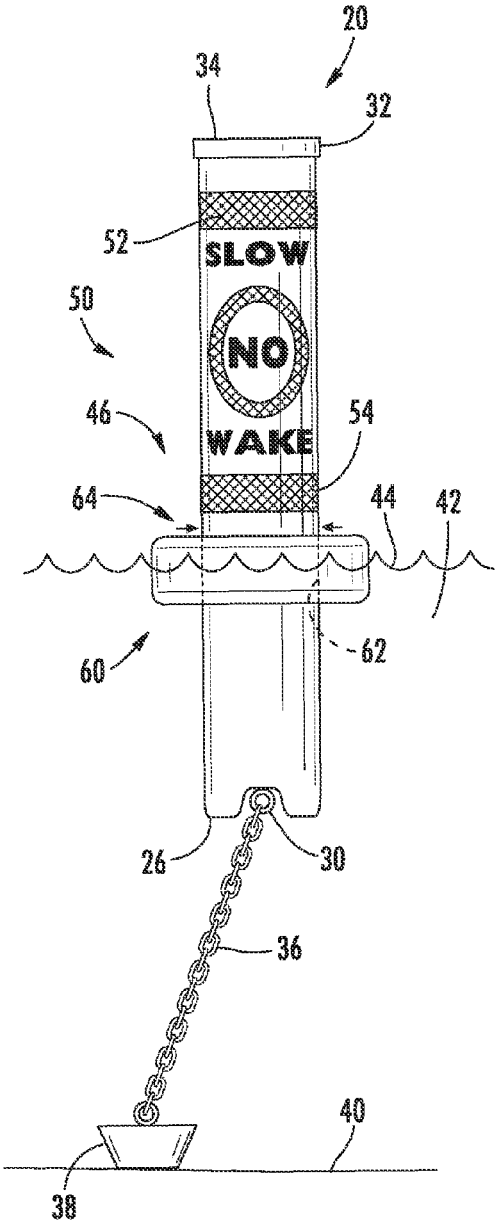
FIG. 2 illustrates the regulatory buoy of FIG. 1 with its buoyancy restored and embodying the invention.
Figure 3:
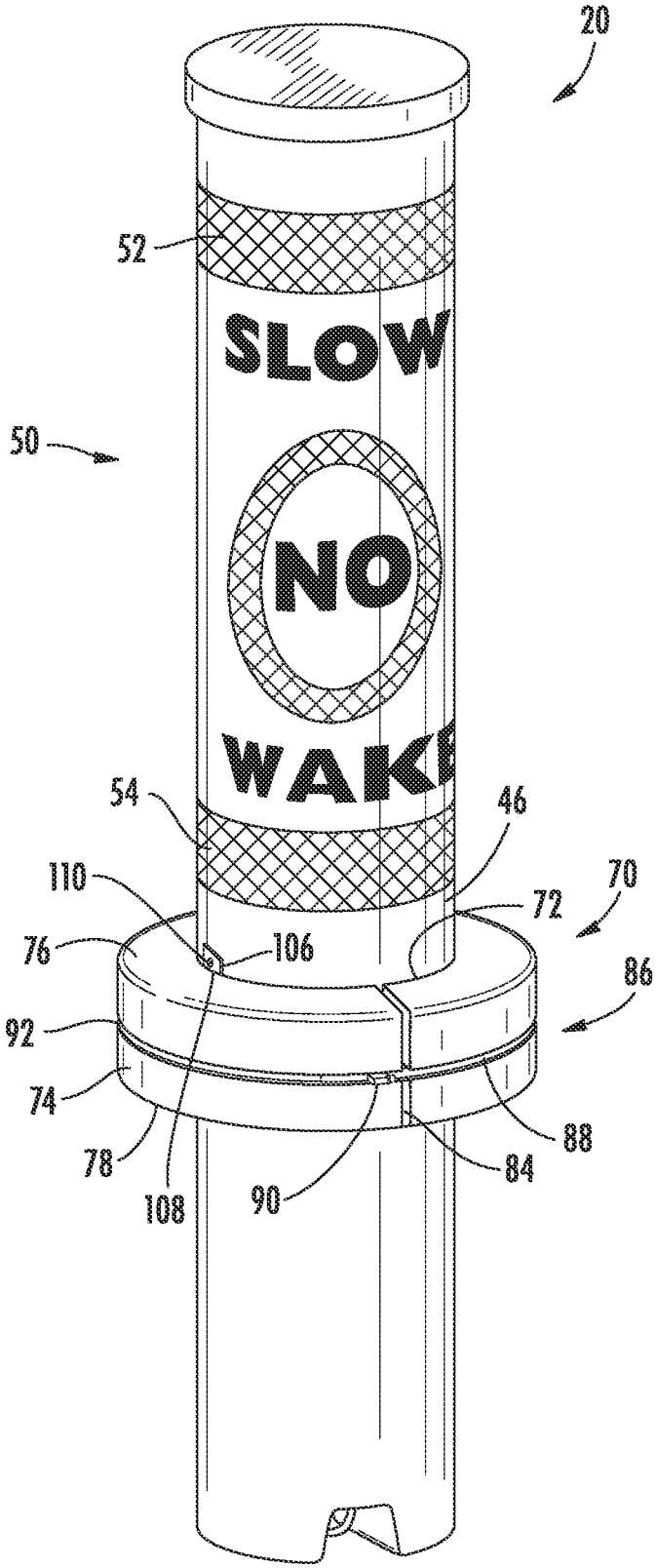
FIG. 3 illustrates a regulatory buoy fitted with a buoyant body, as a first more particular embodiment of the invention.
Figure 4:
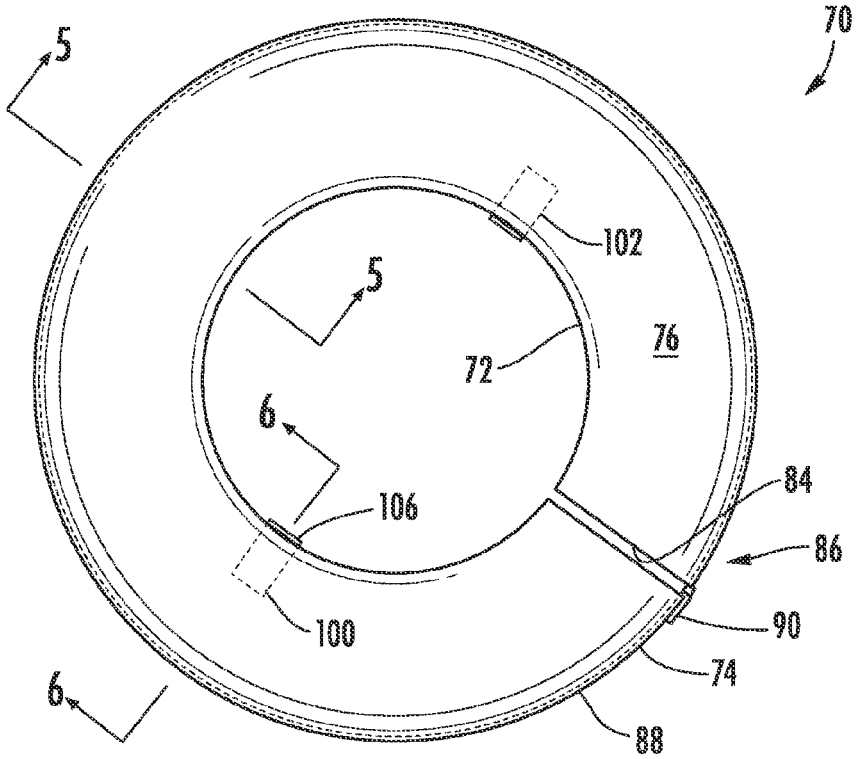
FIG. 4 is a top plan view of the buoyant body of FIG. 3.
Figure 5:
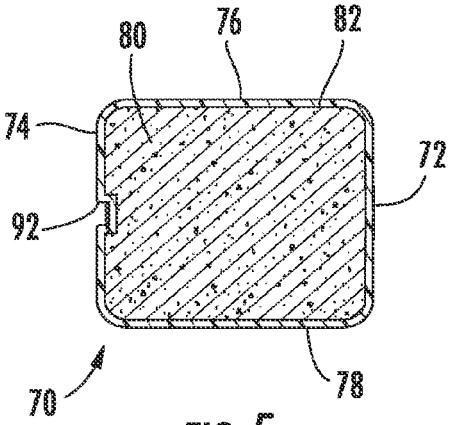
FIG. 5 is a cross-section taken on line 5-5 of FIG. 4.
Figure 6:
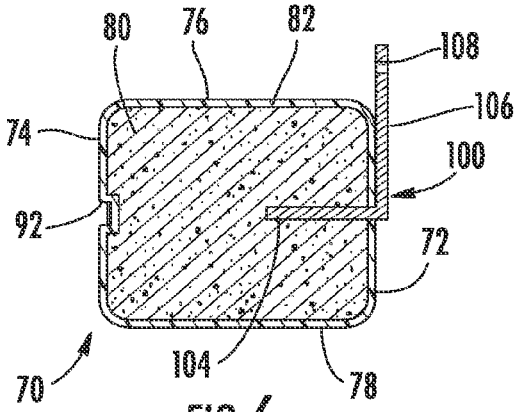
FIG. 6 is a cross-section taken on line 6-6 of FIG. 4.

Referring now to FIG. 2, a buoyant body represented as element 60 embodying the invention is fitted to the cylindrical portion 46 of the buoy 20 generally in the vicinity of or below the intended waterline 56. Thus, in FIG. 2, the actual waterline defined by the intersection with the surface 44 of the body of water 42 generally coincides with the intended waterline 56. Significantly, the lower orange band 54 is entirely above the surface 44 of the body of water 42. The buoyant body 60 illustrated in FIG. 2 is a generalized representation.

The buoyant body 60 is generally of ring configuration. The terminology "ring configuration" is intended to refer to a wide variety of shapes characterized by having an axial central aperture 62. By way of example and not limitation, the buoyant body 60 "of ring configuration" may be generally shaped like a doughnut which is either circular or rectangular in cross-section, or may take the form of a sphere having a vertical aperture.

The axial central aperture 62 has an inside diameter corresponding to the diameter of the cylindrical portion 46 of the buoy 20. This does not mean the inside diameter of the axial central aperture 62 is a tight fit around the cylindrical portion 46. The terminology "corresponding to" means approximately or appropriately sized to fit for purposes of assembly. Depending upon the resiliency of the buoyant body 60, and the particular embodiment, the inside diameter of the central aperture 62 buoyant body 60 may be greater than or less than the diameter of the cylindrical portion 46 of the buoy 20.

An attachment, generally designated 64, is provided for securing the buoyant body 60 to the buoy 20 generally in the vicinity of or below the intended waterline 56, with the buoy cylindrical portion 46 extending through the central aperture 62. (If the buoyant body is secured to the buoy 20 too far below the intended waterline 56, the buoy 20 no longer stands upright.) The representation of the attachment 64 in FIG. 2 is not intended to depict a specific structure. Rather, the illustrated attachment 64 is a generalized representation. As described hereinbelow, the attachment 64, by way of example and not limitation, may take the form of a clamping device, a screw, or both in combination. As another example, set screws (not shown) may be employed.

With reference now to FIGS. 3-6, FIG. 3 more particularly illustrates a first embodiment 70 of a buoyant body fitted to the buoy 20, generally in the manner described hereinabove with reference to FIG. 2. The buoyant body 70 is generally of ring configuration, and has an axial central aperture 72 defining a buoyant body inside diameter corresponding to the diameter of the cylindrical portion 46 of the buoy 20. The body 70 has an outside circumference 74, as well as a top 76 and a bottom 78.

The buoyant body 70 includes a core 80 of polyurethane foam 80, entirely encased in an outer layer of plastic 82, which preferably is somewhat resilient.

To facilitate fitting the buoyant body 70 over the cylindrical portion 46 of the buoy 20, in combination with resilience of the buoyant body 70, there is a radial discontinuity 84, in the representative form of a gap 84 in the buoyant body 70.

An attachment, generally designated 86, is provided for securing the buoyant body 70 to the buoy 20. In the embodiment of FIGS. 3-6, the attachment 86 more particularly includes a clamping device in the form of an adjustable band clamp 88 around the circumference 74 of the buoyant body 70. The adjustable band clamp 88 has a conventional adjustable fastener 90, including a screw. To positively and securely locate the adjustable band clamp 88, an annular recess 92 is provided on the outside circumference 74 of the buoyant body 70, and the adjustable band clamp 88 is received in the annular recess 92.

When the buoyant body 70 is clamped around the buoy 20, preferably the radial discontinuity 84 or gap 84 does not fully close.

While frictional forces of the buoyant body 70 when clamped around the buoy 20 primarily are what secure the buoyant body 70 to the buoy 20, to provide positive position locking, and as part of the attachment 86, a pair of L-shaped tabs 100 and 102 are provided. The tabs 100 and 102 are made of galvanized steel strips bent to a ninety degree angle. One leg 104 of each of the tabs 100 and 102 is either embedded in or pushed into the buoyant body 70 within the central aperture 72. The other leg 106 extends upwardly approximately one to one and one-half inches past the top 76 of the ring-like buoyant body 70, and includes an aperture 108 receiving a screw 110. The screw 110 is a self-tapping screw 110 which penetrates the tube 22 of the buoy, but above the surface 44 so that water does not enter.

Although the attachment 86 includes both the adjustable band clamp 88 (as a primary securing device urging frictional engagement) and the tabs 100 and 102 and screw 110 (as a secondary securing device), it will be appreciated that either form of attachment may be employed by itself in the design of a particular embodiment.

By way of example, the buoyant body 70 may be manufactured by initially forming the core 80 by pouring two-part polyurethane foam into a mold, and allowing the polyurethane foam to cure. A section is cut out to define the radial discontinuity 84. (The annular recess 92 is formed during the molding process, by a protruding molding (not shown) within the mold (not shown).) The two L-shaped tabs 100 and 102 are inserted into the core 80 of polyurethane foam. For aesthetics, protection, and to enhance friction for gripping the buoy 20, the entire assembly is coated with a resilient rubber or plastic layer, preferably by dipping into a resilient plastic coating formulation, and allowing to dry. A suitable coating is sold as Plasti Dip®, an air-dry synthetic rubber coating from Plasti Dip International, of Blaine, Minn.

Figure 7:
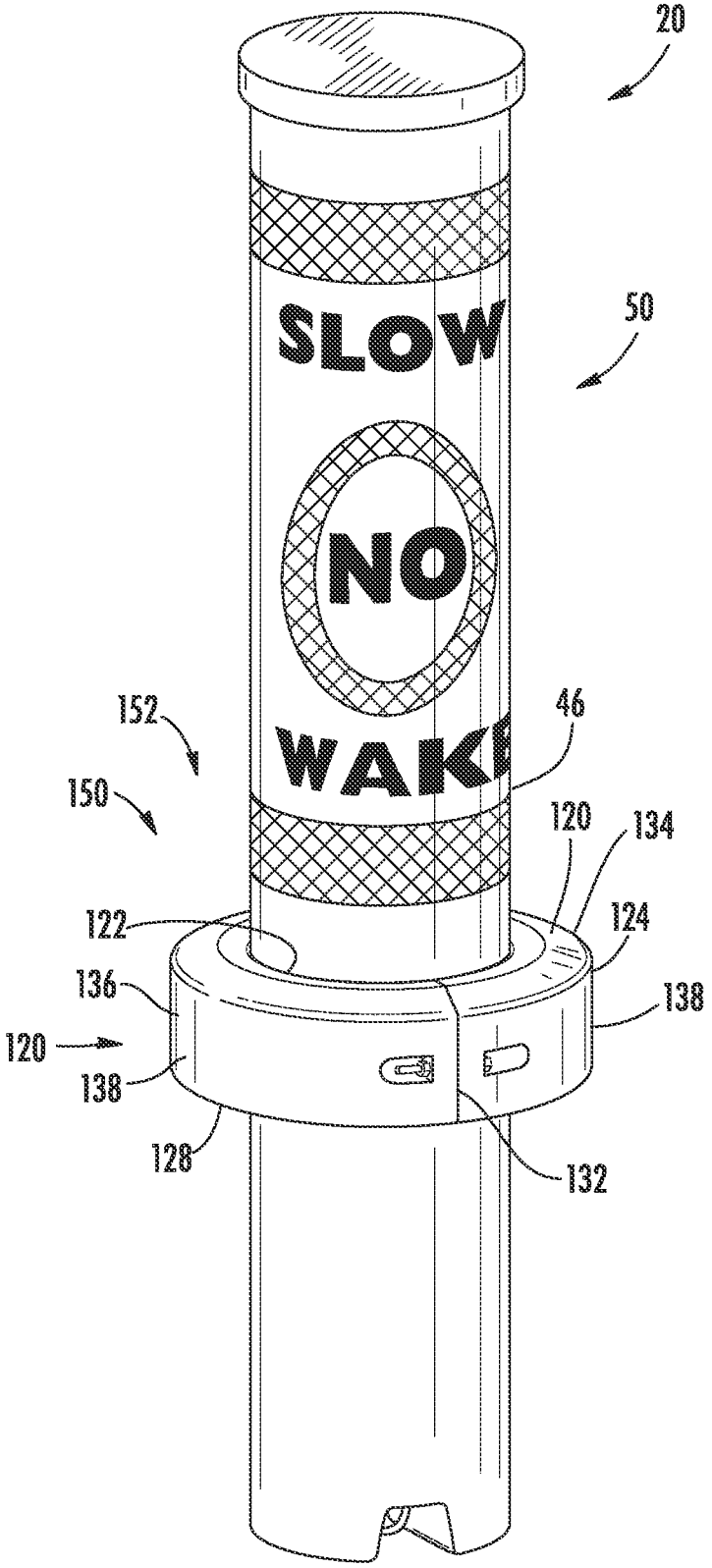
FIG. 7 is a regulatory buoy fitted with a buoyant body, as a second more particular embodiment of the invention.
Figure 8:
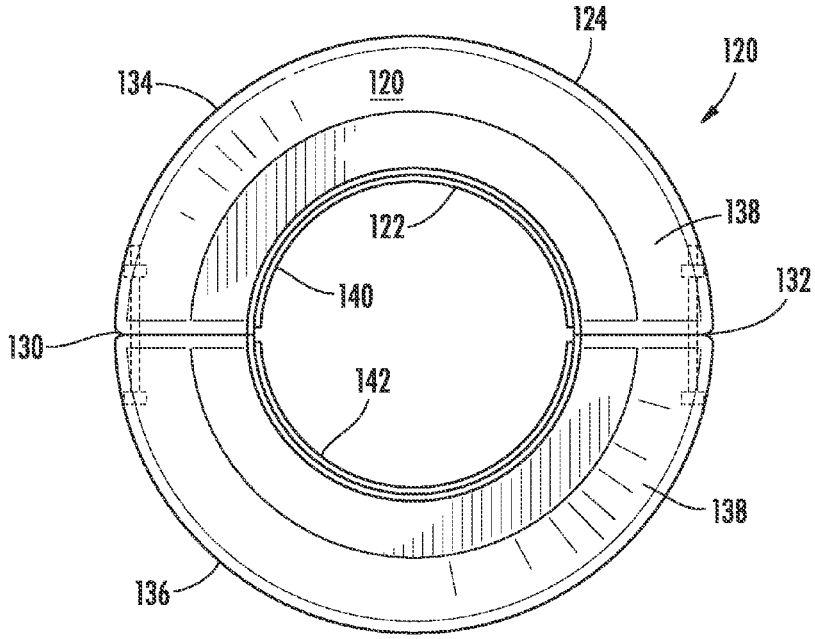
FIG. 8 is a plan view of the buoyant body of FIG. 7.
Figure 9:
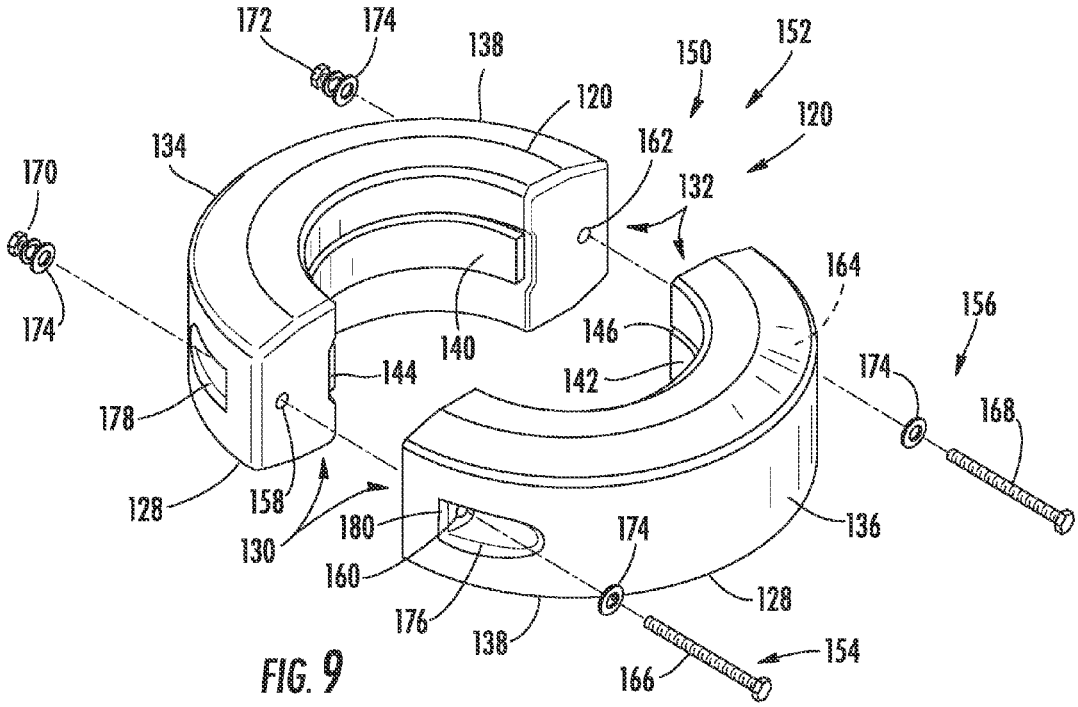
FIG. 9 is a three-dimensional exploded view of the buoyant body of FIG. 7.

With reference now to FIGS. 7-9, FIG. 7 more particularly illustrates a second embodiment 120 of a buoyant body fitted to the buoy 20, again generally in the manner described hereinabove with reference to FIG. 2. The buoyant body 120 is generally of ring configuration, and has an axial central aperture 122 defining a buoyant body inside diameter corresponding to the diameter of the cylindrical portion 46 of the buoy 20. The buoyant body 120 has an outside circumference 124, as well as a top 126 and a bottom 128.

The buoyant body 120 has a pair of diametrically opposed radial discontinuities 130 and 132 which accordingly define two semicircular sections 134 and 136 of the body 120, as best seen in FIG. 9. It will be appreciated that the resultant splitting of the buoyant body 120 into the two sections 134 and 136 facilitates fitting the buoyant body 120 around the cylindrical portion 40 of the buoy 20.

Each of the semicircular sections 134 and 136 has a flotation foam core (not shown) and a plastic outer shell 138, for example made of polyethylene. To enhance frictional engagement, rubber strips 140 and 142 are located within the central aperture 122 of the buoyant body 120, partially within but yet projecting from locating recesses 144 and 146.

An attachment, generally designated 150, is provided for securing the buoyant body 120 to the buoy 20. In the embodiment of FIGS. 7-9, the attachment 150 more particularly includes a clamping device 152 including, in addition to the splitting of the buoyant body 120 into two semicircular sections 134 and 136, bolts 154 and 156 passing through apertures 158, 160 and 162, 164 in the semicircular sections 134 and 136 at the locations of the radial discontinuities 130 and 132. The bolts 154 and 156 more particularly comprise machine screws 166 and 168 and nuts 170 and 172. Washers 174 are also provided. At one end of each of the apertures 158, 160 and 162, 164 recesses 176 and 178 are provided in the outer circumference 124 of the body 120 so that the bolts 154 and 156 do not project beyond the circumference 124. Bearing surfaces, such as the bearing surface 180 visible in FIG. 9, are provided for the bolts.

Figure 10:
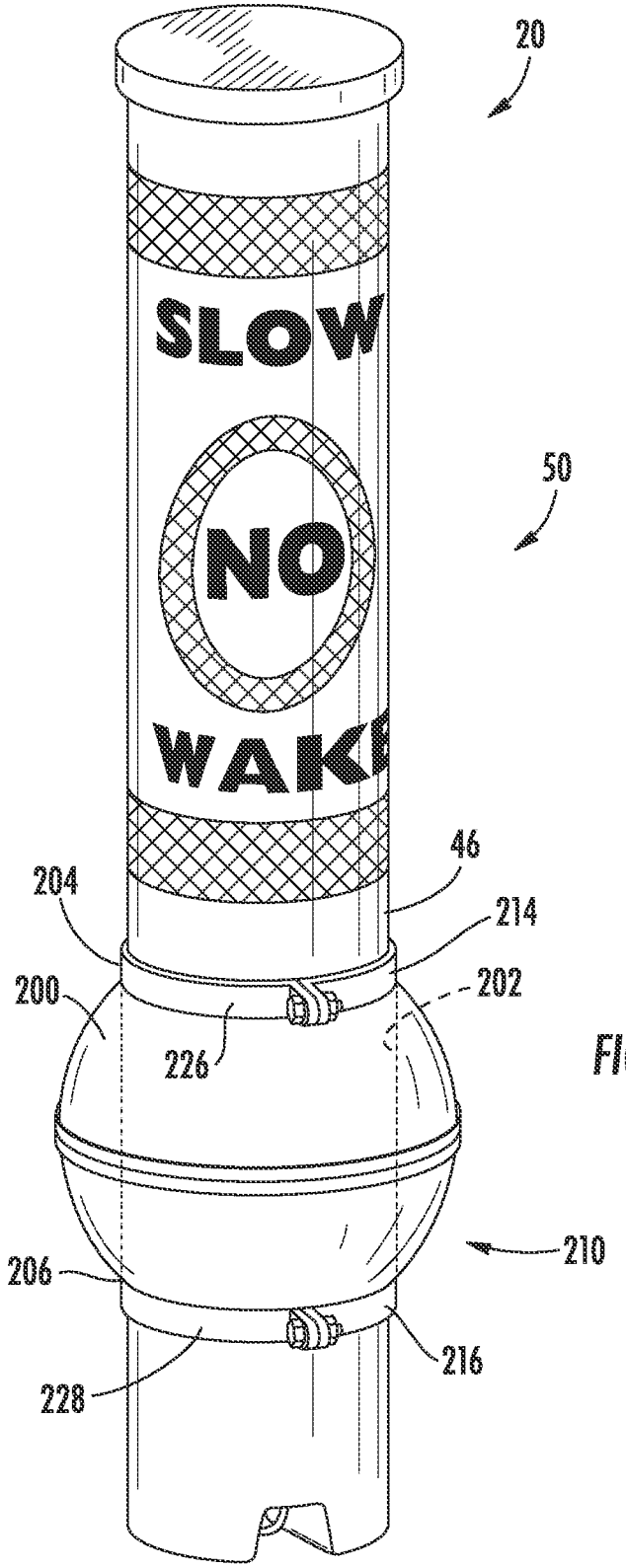
FIG. 10 illustrates a regulatory buoy, with a buoyant body fitted, as a third more particular embodiment of the invention.
Figure 11:
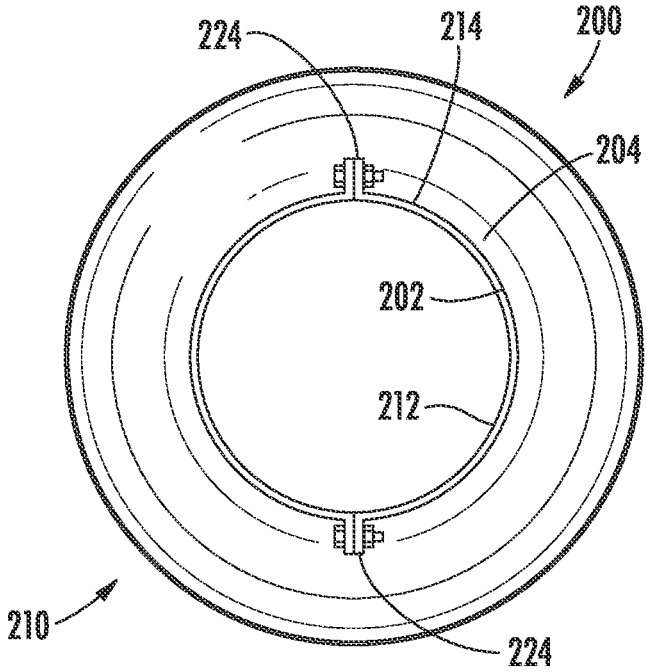
FIG. 11 is a top plan view of the buoyant body of FIG. 10.
Figure 12:
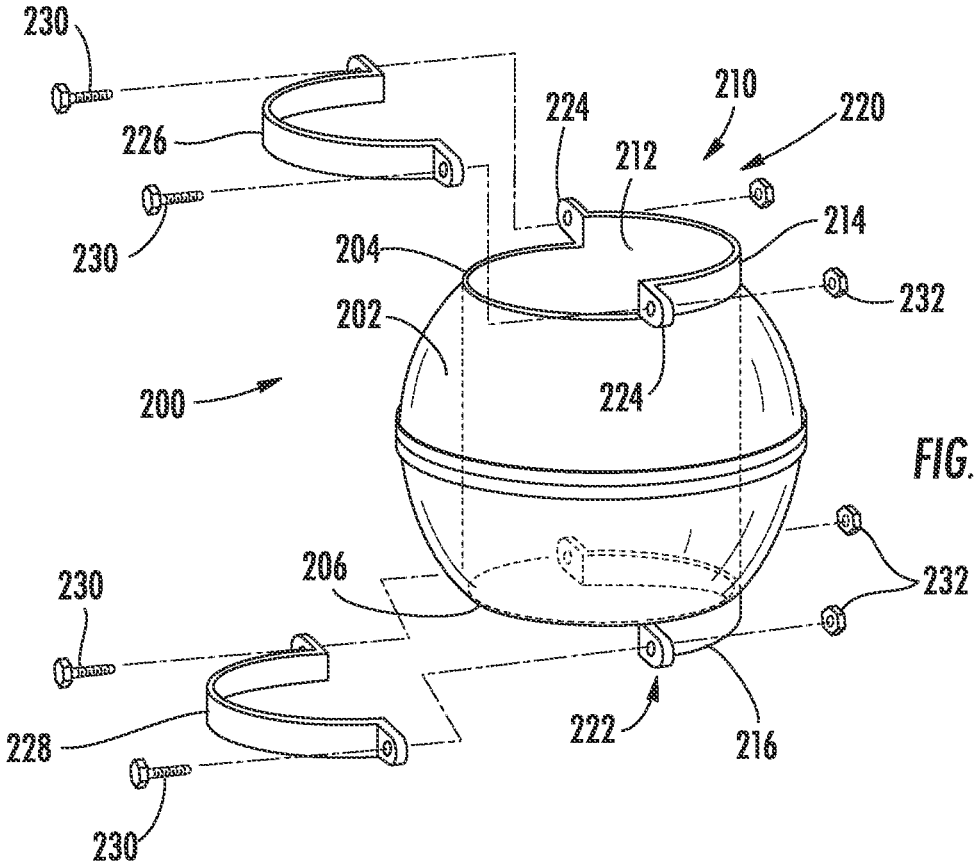
FIG. 12 is a three-dimensional view of the buoyant body of FIG. 10.

With reference now to FIGS. 10-12, FIG. 10 more particularly illustrates a third embodiment 200 of a buoyant body fitted to the buoy 20, again generally in the manner described hereinabove with reference to FIG. 10. The buoyant body 200 is generally of ring configuration, in the more particular form of a sphere having an axial central aperture 202 defining a buoyant body inside diameter corresponding to the diameter of the cylindrical portion 46 of the buoy 20. The buoyant body 200 has a top 204 and a bottom 206. As in the previous embodiments, the buoyant body 100 has a hard plastic outer shell surrounding a flotation foam core.

An attachment, generally designated 210, is provided for securing the buoyant body 200 to the buoy 20. In the embodiment of FIGS. 10-12, the attachment 210 more particularly includes a cylindrical sleeve 212 extending through the central aperture 202 and attached, such as by adhesive, to the buoyant body 200. The cylindrical sleeve 212 may be made of plastic pipe, and fits loosely around the cylindrical portion 46 of the buoy 20 to facilitate assembly.

The cylindrical sleeve 212 has at least one extending portion which extends above or below the buoyant body 200. In the embodiment illustrated in FIGS. 10-12, there are two such extending portions, an upper extending portion 214 which extends past the top 204 above the buoyant body 200, and a lower extending portion 216 which extends past the bottom 206 below the buoyant body 200.

Clamps generally designated 220 and 222 are fitted to the extending portions 214 and 216. More particularly, the extending portions 214 and 216 are cut or formed so as to encompass one-half the diameter of the cylindrical sleeve 212, and radially-extending clamp attachment surfaces 224 are provided, either integrally or as separate pieces. A pair of corresponding semicircular clamp pieces 226 and 228 are provided, secured by machine screws 230 and nuts 232.

It will be appreciated that various alternative constructions may be provided. For example, rather than the clamp attachment surfaces 224 cooperating with the clamp pieces 226 and 228, band clamps may be provided wrapping around the one-half diameter extending portions 214 and 216 and the cylindrical portion 46 of the buoy 20. Saddle clamps may as well be employed.

Figure 13:
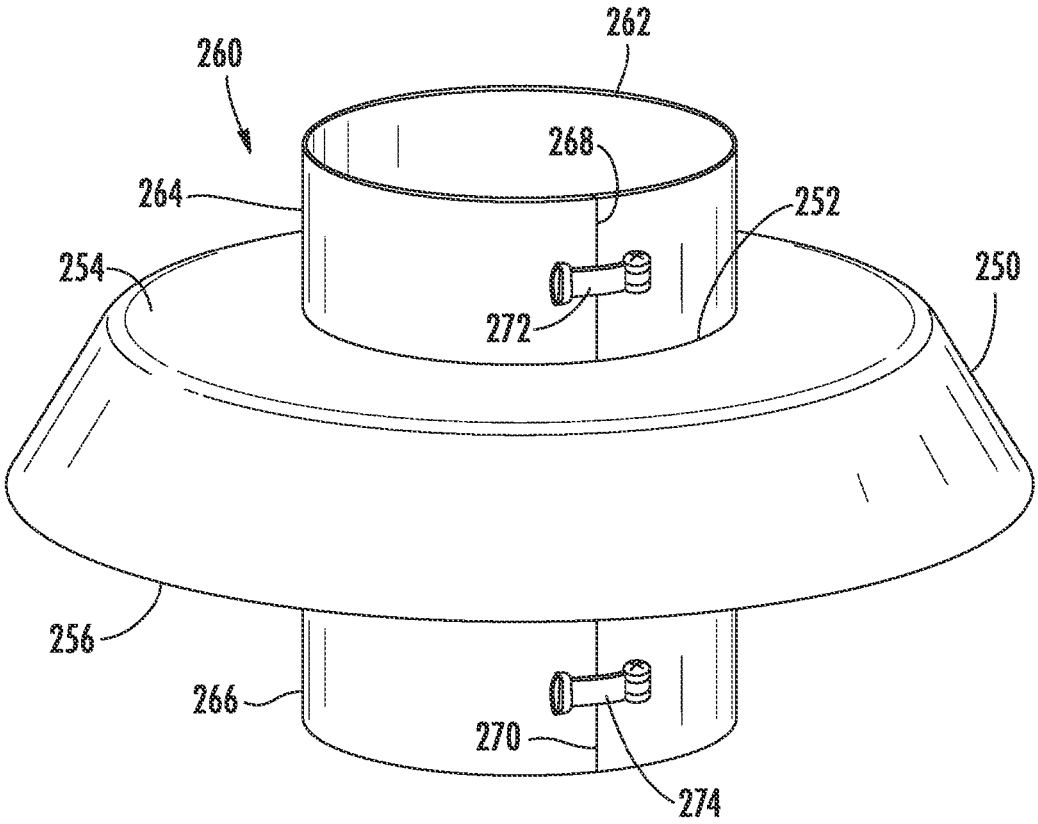
FIG. 13 is a three-dimensional view of a fourth more particular embodiment of the invention.

Referring finally to FIG. 13, a fourth embodiment 250 of a buoyant body is illustrated, generally of ring configuration, and having an axial central aperture 252 defining a buoyant body inside diameter corresponding to the diameter of the cylindrical portion of the buoy 20. The buoyant body 250 has a top 254 and a bottom 256.

The embodiment of FIG. 13 is similar to the embodiment of FIGS. 10-12, in that an attachment 260 is provided in the form of a cylindrical sleeve 262 having upper and lower extending portions 264 and 266. The cylindrical sleeve 262 in FIG. 13 is made of metal, such as stainless steel.

In FIG. 13, the extending portions 264 and 266 have discontinuities 268 and 270 or gaps 268 or 270 which, when pulled together, cause the extending portions 264 and 266 to clamp around the cylindrical portion 46 of the buoy 20. Suitable clamp devices 272 and 274 are provided to selectively open and close the gaps or discontinuities 268 and 270.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A restored buoy assembly comprising:

a buoy which has an intended waterline and, prior to restoration, an actual waterline above the intended waterline, said buoy at least including a cylindrical portion having a diameter; and a buoyant body generally of cylindrical ring configuration defining a central axis, and including an axial central aperture on the central axis, said buoyant body having a buoyant body inside diameter corresponding to said diameter of said cylindrical portion of said buoy;

said buoyant body being secured to said buoy generally in said vicinity of or below said intended waterline so as to provide restoration, said buoy cylindrical portion extending through said central aperture.

2. The assembly of claim 1, wherein said buoyant body has a radial discontinuity which, in combination with resilience of said buoyant body, facilitates fitting said buoyant body over said cylindrical portion of said buoy.

3. The assembly of claim 2, comprising a clamping device including an adjustable band clamp around said circumference of said buoyant body.

4. The assembly of claim 1, wherein said buoyant body has a pair of diametrically opposed radial discontinuities defining two semicircular sections of said body to facilitate fitting said buoyant body around said cylindrical portion of said buoy.

5. The assembly of claim 4, comprising a clamping device including bolts passing through apertures in said semicircular sections at said locations of said radial discontinuities for securing said semicircular sections to each other.

6. The assembly of claim 1, comprising a clamping device including:

a cylindrical sleeve extending through said central aperture and attached to said buoyant body, said cylindrical sleeve having at least one extending portion which extends above or below said buoyant body, and said cylindrical sleeve having a cylindrical sleeve inside diameter such that said cylindrical sleeve fits loosely around said cylindrical portion of said buoy; and a clamp fitted to said extending portion.

7. A method for restoring buoyancy to a buoy which has lost buoyancy, the buoy having an intended waterline and an actual waterline above the intended waterline, the buoy at least including a cylindrical portion having a diameter, said method comprising:

providing a buoyant body generally of cylindrical ring configuration defining a central axis including an axial central aperture on the central axis, the buoyant body having a buoyant body inside diameter corresponding to the diameter of the cylindrical portion of the buoy; and fitting and attaching the buoyant body to the buoy generally in the vicinity of or below the intended waterline, with the buoy cylindrical portion extending through the central aperture of the buoyant body.

8. The method of claim 7, which further comprises providing the buoyant body with a radial discontinuity which, in combination with resilience of the buoyant body, facilitates fitting the buoyant body over the cylindrical portion of the buoy.

9. The method of claim 8, which comprises providing a clamping device in the form of an adjustable band clamp around the circumference of the buoyant body.

10. The method of claim 7, which comprises providing the buoyant body with a pair of diametrically opposed radial discontinuities defining two semicircular sections of the body to facilitate fitting the buoyant body around the cylindrical portion of the buoy.

11. The method of claim 10, which comprises providing a clamping device in the form of bolts passing through apertures in the semicircular sections at the locations of the radial discontinuities for securing the semicircular sections to each other.

12. The method of claim 7, which comprises providing a clamping device in the form of:

a cylindrical sleeve extending through the central aperture and attached to the buoyant body, the cylindrical sleeve having at least one extending portion which extends above or below the buoyant body, and the cylindrical sleeve having a cylindrical sleeve inside diameter such that the cylindrical sleeve fits loosely around the cylindrical portion of the buoy; and a clamp fitted to the extending portion.

* * * * *